United States Patent [19]

Ototani

[11] Patent Number: 4,944,798

[45] Date of Patent: Jul. 31, 1990

[54] METHOD OF MANUFACTURING CLEAN STEEL

[75] Inventor: Tohei Ototani, Tokyo, Japan

[73] Assignee: Metal Research Corporation, Tokyo, Japan

[21] Appl. No.: 363,570

[22] Filed: Jun. 7, 1989

[30] Foreign Application Priority Data

Feb. 1, 1989 [JP] Japan ..... 1-20817

[51] Int. Cl.[5] ..... C21C 7/02

[52] U.S. Cl. ..... 420/85; 75/508; 75/526

[58] Field of Search ..... 75/53, 58, 57

[56] References Cited

U.S. PATENT DOCUMENTS 3,107,995 10/1963 Katakura ..... 75/57
3,467,167 9/1969 Mahin ..... 75/57
3,933,480 1/1976 Tipnis ..... 75/57

*Primary Examiner*—Peter D. Rosenberg

*Attorney, Agent, or Firm*—Sughrue, Mion, Zinn, Macpeak & Seas

[57] ABSTRACT

The disclosed method is a method of manufacturing clean steel comprising refining molten steel by adding additives of from not more than 0.5% to more than 0.001% by weight of molten steel to the molten steel bath, in vacuo or a non-oxidizing atmosphere within a melting furnace or vessel made of or lined with a basic refractory material consisting essentially of 7–90 wt % of CaO and 90–7 wt % of MgO, which total content being 70% to 99.9%, and optionally included a basic refractory material consisting of 30–0.1 wt % of at least one element selected from the group consisting of $Al_2O_3$, CrO, $ZrO_2.SiO_2$, $ZrO_2$, ZrC and C as selected components, and obtaining clean steel containing less than 30 ppm of oxygen, less than 30 ppm of sulfur, less than 150 ppm of nitrogen, 5 to 0.1 ppm of Mg and 25 to 0.1 ppm of Ca. Said additives comprises Al and at least one optional element selected from Ti, Nb, Ta, B and alkali earth metal. 5% of a solvent can be included to said additives.

5 Claims, 4 Drawing Sheets

Phase diagram of CaO-MgO system

Phase diagram of CaO-MgO-$Cr_2O_3$ system

Phase diagram of $ZrO_2$-CaO-MgO system

Phase diagram of CaO-MgO-$Al_2O_3$ system

Hydration properties in saturated vapor of CaO, CaO-30%MgO, 20%CrO-CaO-30%MgO (50°C)

METHOD OF MANUFACTURING CLEAN STEEL

BACKGROUND OF THE INVENTION (a) Field of the Invention

The present invention relates to a method of manufacturing a ferroalloy of super high purity, and relates to a method of manufacturing steel containing extremely small amounts of oxygen, sulfur and nitrogen, and small amounts of magnesium and calcium.

(b) Related Art Statement

The inventor has previously proposed a method of manufacturing molten steel having less contents of oxygen and sulfur as Japanese Patent Laid-open No. 52(1977)-58,010 and Japanese Patent Application Publication No. 62(1987)-37,687.

The inventor has further proposed iron-, nickel-, and cobalt-base alloy having extremely small contents of sulfur, oxygen and nitrogen and a method of manufacturing the same as Japanese Patent Laid-open No. 62(1987)-83,435.

According to the above prior methods, the residual sulfur is less than 0.002%, the residual oxygen is less than 0.002% and the residual nitrogen is less than 0.03% in molten steel.

That is, the invention of Japanese Patent Laid-open No. 62(1987)-83,435 relates to a method of manufacturing an iron-base alloy having extremely small contents of oxygen, sulfur and nitrogen comprising a step of substantially melting an iron alloy in a crucible consisting of basic refractories containing 15–75 wt% of MgO and 15–85 wt% of CaO, or a crucible, a crucible melting furnace, a converter or a vessel such as a ladle lined with said refractories, a deoxidizing, desulfurizing and denitrifying the molten alloy in a non-oxidizing atmosphere such as argon gas, nitrogen gas or helium gas or in vacuo, by adding first and second additives, the first additive being aluminum or aluminum alloy, and the second additive being selected from the group consisting of boron, alkali metal and alkali earth metal, and casting the thus deoxidized, desulfurized and denitrified molten alloy into an ingot.

According to this method, in order to have

| | |
|---|---|
| residual Al | 0.005–7% |
| residual Mg | 0.005–0.0005% |
| residual Ca | 0.005–0.0001% |
| total residual amount of at least one element selected from the group consisting of boron, alkali metal and alkali earth metal | 0.001–10 wt. % |

these metals are preferably added.

SUMMARY OF THE INVENTION

An object of the invention is to improve spalling resistance and hydrating properties as compared with conventional natural dolomite and synthetic calcia.-magnesia refractories.

An object of the invention is to provide a method of manufacturing clean steel comprising refining molten steel by adding additives of from not more than 0.5% to more than 0.001% by weight of molten steel to the molten steel bath, said additives being Al and at least one optional element selected from the group consisting of Ti, Nb, Ta, B and alkali earth metal, and less than 5% of an optional solvent, in vacuo or a non-oxidizing atmosphere within a melting furnace or vessel having a furnace wall made of or lined with a basic refractory material consisting essentially of 7–90 wt% of CaO and 90–7 wt% of MgO, which total content being 70% to 99.9%, and an optional element of 30–0.1 wt% of at least one element selected from the group consisting of $Al_2O_3$, CrO, $ZrO_2.SiO_2$, $ZrO_2$, $SiO_2$, ZrC and C, and obtaining clean steel containing less than 30 ppm of oxygen, less than 30 ppm of sulfur, less than 150 ppm of nitrogen, 5 to 0.1 ppm of Mg and 25 to 0.1 ppm of Ca.

Another object of the invention is to provide a method of manufacturing clean steel comprising refining molten steel by adding metallic calcium or metallic calcium-containing alloy of from less than 0.1 to more than 0.001% by weight of molten steel with the aid of an iron-clad calcium wire to a molten steel bath in vacuo or a non-oxidizing atmosphere to the molten steel bath in a melting furnace or a vessel having a furnace wall made of or lined with a basic refractory material consisting essentially of 7–90 wt% of CaO and 90–7 wt% of MgO, which total content being 70% to 99.9%, and an optional element of 30–0.1 wt% of at least one element selected from the group consisting of $Al_2O_3$, CaO, $ZrO_2.SiO_2$, $ZrO_2$, $SiO_2$, ZrC and C, and adding less than 5% of an optional solvent, and obtaining clean steel containing less than 20 ppm of oxygen, less than 20 ppm of sulfur, less than 150 ppm of nitrogen, 5 to 0.1 ppm of Mg and 25 to 0.1 ppm of Ca.

A further object of the invention is to provide a method of manufacturing clean steel comprising refining molten steel by adding an iron-sheathed calcium clad wire containing metallic calcium or metallic calcium-containing alloy in molten weight of less than 0.1% to more than 0.001% by weight of molten steel and less than 5% of a solvent of at least one element selected from halide, carbide and carbonate of alkali or alkali earth metal, in vacuo or a non-oxidizing atmosphere to the molten steel bath in a melting furnace or a vessel having a furnace wall made of or lined with a basic refractory material consisting essentially of 7–90 wt% of CaO and 90–7 wt% of MgO, which total content being 70% to 99.9%, and an optional element consisting of 30–0.1 wt% of at least one element selected from $Al_2O_3$, CaO, $ZrO_2.SiO_2$, $ZrO_2$, $SiO_2$, ZrC and C, and obtaining clean steel containing less than 20 ppm of oxygen, less than 20 ppm of sulfur, less than 150 ppm of nitrogen, 5 to 0.1 ppm of Mg and 25 to 0.1 ppm of Ca.

DESCRIPTION OF THE PREFERRED EMBODIMENTS

The invention will be explained by referring to drawings.

Figure 1:
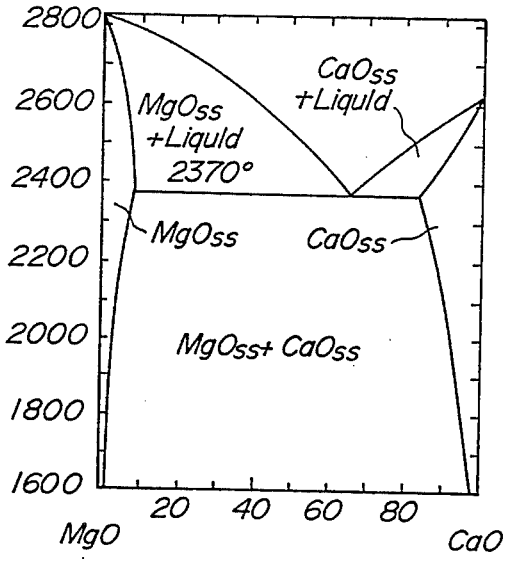
FIG. 1 is a phase diagram of CaO-MgO refractories used in the present invention.
Figure 2:
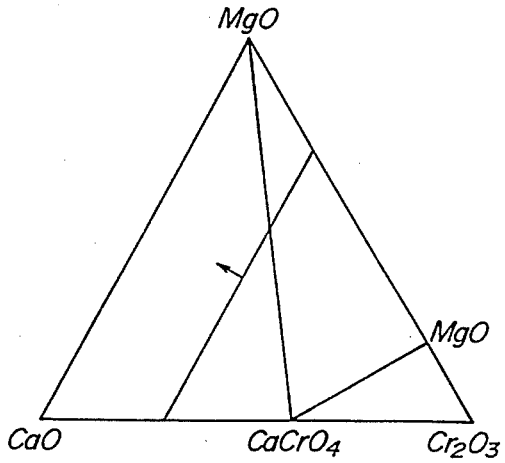
FIG. 2 is a phase diagram of CaO-MgO-$Cr_2O_3$ refractories used in the present invention.
Figure 3:
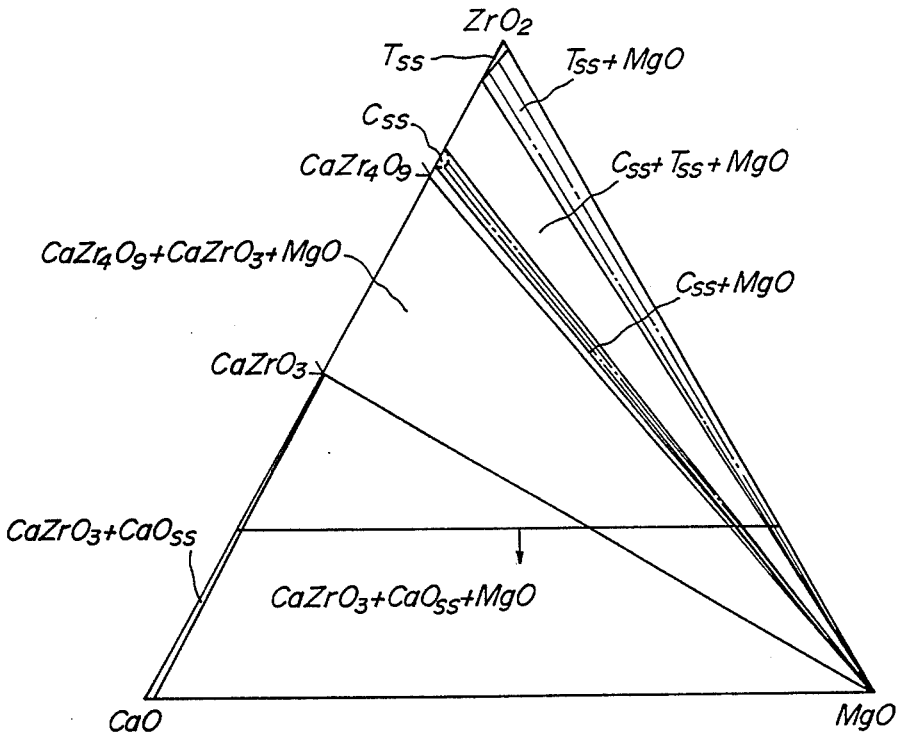
FIG. 3 is a $ZrO_2$-CaO-MgO composition used in the present invention.

FIG. 1 is a phase diagram of CaO-MgO system binary refractories by mixing CaO with MgO. FIG. 2 shows a phase diagram of $CaO-MgO-Cr_2O_3$ tertiary system refractories. From FIG. 2 of this phase diagram is obtained a mixed structure of $CaO-MgO-CaCrO_4$ system by adding $Cr_2O_3$. FIG. 3 shows a tertiary phase diagram of refractories of $CaO-MgO-ZrO_2$, and as apparent from FIG. 3, the refractories are a mixed structure of $CaZrO_3+CaO$ solid solution+MgO.

Figure 4:
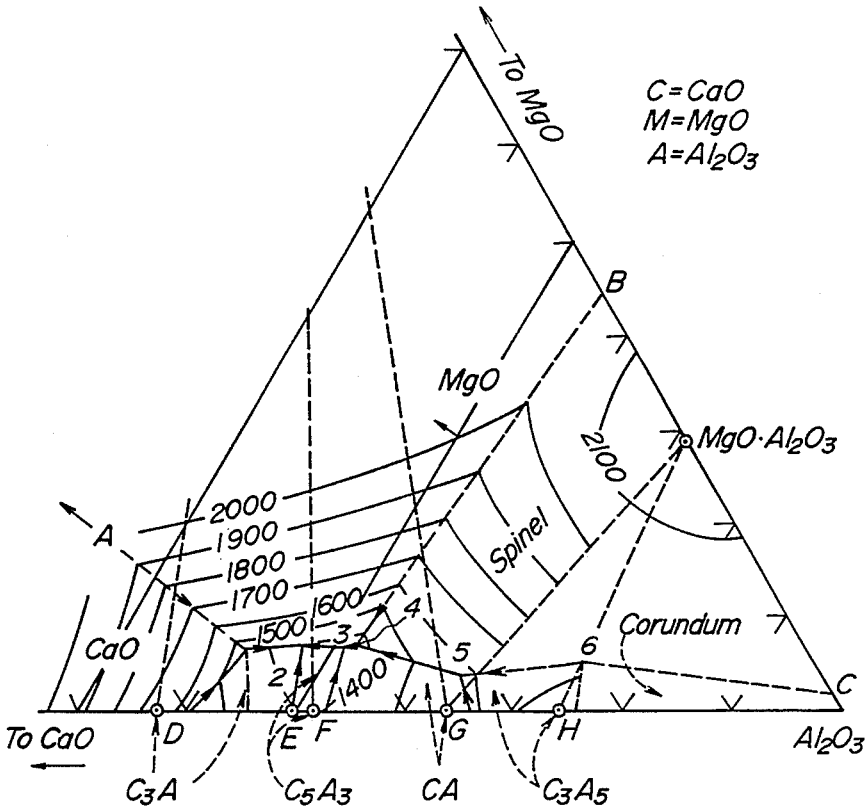
FIG. 4 is a phase diagram showing hydration characteristics of CaO, CaO-30%MgO, 20%CrO-CaO-30%MgO of CaO-MgO-$Al_2O_3$ refractories used in the present invention in saturated vapor at 50° C.

FIG. 4 shows a phase diagram of tertiary refractories of $CaO-MgO-Al_2O_3$, and as apparent from FIG. 4, the refractories are a mixed structure of $CaO-MgO-5CaO_3Al_2O_3$. These tertiary refractories apparently contain carbide and silicate in part with respect to quarterly refractories of the present invention which further include C and $SiO_2$ in each of these tertiary refractories.

The phase diagrams of the refractories according to the present invention are rather complicated depending upon the structure and phase diagram, but there are effects of improving spalling resistance by contents and components of tertiary oxides other than CaO and MgO as compared with CaO, MgO and refractories, and more especially, the effect is a remarkably improved, except quarterly refractories containing silicate.

Figure 5:
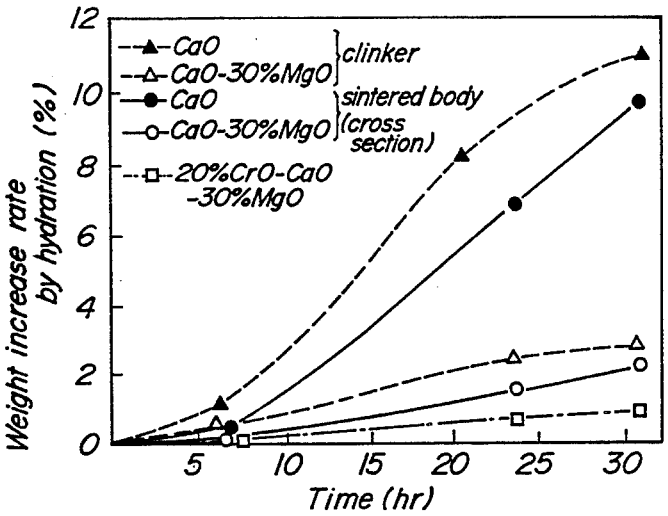
FIG. 5 is a phase diagram showing hydration characteristics of CaO, CaO-30%MgO, 20%CrO-CaO-30%MgO in saturated vapor at 50° C.

FIG. 5 shows the comparative data of hydration properties by comparing the prior data of the fired refractories with respect to the starting material of MgO-70%CaO and with the refractories of 25%MgO-56%CaO containing 18% $Cr_2O_3$. It becomes clear from this comparative data that hydration resistance is improved by mixing 18% of $Cr_2O_3$. Hydration properties of refractories made by mixing tertiary oxide of less than 30% of the present invention with calcia-magnesia (CaO-MgO) is complicately influenced by carbonation and preliminary treatment of the exposed surface, system, porosity and the like, but it is apparent from each phase diagram of tertiary refractories that a mixed structure is obtained by adding a tertiary oxide, whereby hydration properties are greatly improved.

Next, the reason why the components and compositions of refractories are limited in the present invention will be explained as follows.

(a) In case that the total content of CaO-MgO is 70% to more than 99.9%:

From a refining effect of active Ca and Mg by reducing CaO-MgO of refractories and an effect of improving hydration resistance of tertiary oxide, the above composition range is determined by taking their harmonic points into consideration.

(b) In case that $Al_2O_3$, $Cr_2O_3$, $ZrO_2.SiO_2$, $ZrO_2$, $SiO_2$, ZrC and C are 30–0.1%:

The above composition range is determined by taking the harmonic points of an improved effect of hydration resistance of CaO-MgO and a refining effect of CaO-MgO of refractories by a reducing agent such as Al and the like.

(c) In case of less than 30 ppm of oxygen, less than 30 ppm of sulfur and less than 150 ppm of nitrogen:

As a result of actual operation, the upper limits are determined by aiming at the range for attaining high purity steel.

(d) In case of 5–0.1 ppm of Mg and 25–0.1 ppm of Ca:

From a result in actual operation, Ca immediately after adding 0.1% of Al becomes 5 to 6 ppm within a tundish, and the Ca content of product becomes 2 to 3 ppm, and hence, the content of residual calcium (Ca) is determined to be less than 25 ppm to 0.1 ppm.

In the same manner, the content of magnesium (Mg) within a tundish is reduced by half in a product, and as a result, the content of residual magnesium (Mg) is determined to be less than 5 ppm to 0.1 ppm.

EXAMPLE 1

80% of a CaO-MgO clinker and 20% of a zirconia oxide containing 95% of $ZrO_2$ were mixed and fired at 1,600° C. to manufacture a crucible of 80 mm in outer diameter and about 160 mm in height. A high frequency vacuum induction furnace of 10 KW and 50 KHz was used for melting, and a desired amount of additive metal was added to about 1 kg of an electrolytic iron molten bath, in which concentration of O and S was previously adjusted, at an argon atmosphere under pressure at 1,600° C.

The additive metal was 0.5% of Al, and at least one element not more than 0.5% and more than 0.001% of Ti, Zr, Ce and the like having purity of more than 99%, if necessary, is added together with less than 5% of a solvent.

As a result of adding 0.5% of Al, the residual amounts of O, S, N, Mg and Ca in the electrolytic iron molten bath after 10 minutes were O=12 ppm, S=2 ppm, N=27 ppm, Mg=4 ppm, and Ca=1 ppm.

The desulfurization result after an experiment with the use of Ti, Zr and Ce was S=2 ppm after adding Al, and in the case of adding Zr, S=17 ppm, in the case of adding Ti, S=20 ppm, and after adding Ce, S=95 ppm, resulting in less desulfurization effect of rare earth metal.

EXAMPLE 2

A Ca-Si alloy was added to an RH vessel, and a Ca-Si clad wire was added to a ladle after completing treatment in an RH-type vacuum degassing device, respectively, and a residual amount of Ca and a morphological change of an inclusion were examined. Table 1 shows the composition of Ca-Si alloy and Ca-Si clad wire added.

TABLE 1

| Material | Chemical compositions of Ca-Si alloy and Ca-Si wire | | |
|---|---|---|---|
| | Fe | Ca | Si |
| Ca-Si alloy | — | 32 | 60 |
| Ca-Si wire | 55 | 14.4 | 27 |

100 tons of low carbon aluminum killed steel in a ladle was treated in an RH-type vacuum degassing device and continuously cast in a bloom of 250×370 mm. The ladle is lined in a furnace wall with refractory bricks consisting essentially of 56% of CaO, 25% of MgO and 18% of $Cr_2O_3$, and as a slag lining, MgO brick was used.

Figure 6:
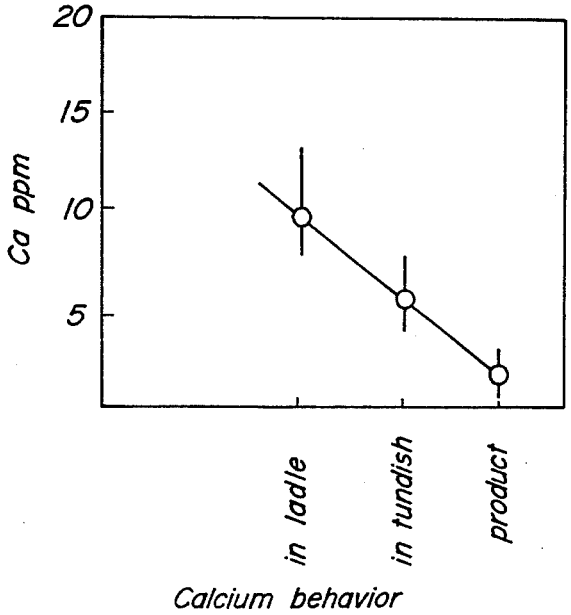
FIG. 6 is a graph showing a calcium behavior of the present product in a tundish and ladle.

FIG. 6 shows an example of a behavior of Ca. The content of 10-odd ppm of Ca after addition into the ladle became 5–8 ppm in a tundish. Residual Ca was 2–3 ppm and Mg was 3–4 ppm in the product. In the product, $O_2$=12–9 ppm, S=81∝12 ppm and $N_2$=28 ppm. There was no nozzle closure, nor morphological change of the inclusion.

EXAMPLE 3

With the use of a ladle of 80 tons having a furnace wall consisting essentially of tertiary refractories of 35% of CaO, 45% of MgO and 18% of $ZrO_2.SiO_2$, low Cr alloy steel was secondarily refined with basic slag in an RH-type vacuum degassing device.

Into the ladle, 0.1 of a Ca-Si clad wire (55% Fe, 14.4% Ca, 27% Si) was added into the ladle. The analytical result of typical 3 charges is as shown in Table 2.

TABLE 2

| Sample component | A | B | C |
|---|---|---|---|
| C% | 0.18 | 0.19 | 0.20 |
| Cr% | 1.15 | 1.27 | 1.10 |
| Ca ppm | 1.5 | 2.5 | 2.3 |
| Mg ppm | 1.1 | 1.6 | 1.4 |
| Sol Al% | 0.035 | 0.038 | 0.039 |
| $O_2$% | 0.0010 | 0.0009 | 0.0011 |
| S% | 0.0018 | 0.0010 | 0.0015 |
| $N_2$% | 0.0040 | 0.0035 | 0.0038 |

As described above, both the residual contents of Ca and Mg were less than 5 ppm, but deoxidation and desulfurization effects were as remarkably expected.

What is claimed is:

1. A method of manufacturing clean steel comprising refining molten steel by adding additives of from not more than 0.5% to more than 0.001% by weight additives of from not more than 0.5% to more than 0.001% by weight of molten steel to the molten steel bath; said additives being Al together with at least one element selected from the group consisting of Ti, Nb, Ta, B and alkali earth metal in vacuo or a non-oxidizing atmosphere within a melting furnace or vessel made of or lined with a basic main refractory material consisting essentially of 7–90 wt% of CaO and 90–7 wt% of MgO, wherein the total content of CaO and MgO is 70% to b 99.9%, and wherein there is included another refractory material consisting of 30–0.1 wt% of at least one element selected from the group consisting of $Al_2O_3$, CrO, $ZrO_2.SiO_2$, $ZrO_2O$, $SiO_2$, ZrC and C as supplemental components, and obtaining clean steel containing less than 30 ppm of oxygen, less than 30 ppm of sulfur, less than 150 ppm of nitrogen, 5 to 0.1 ppm of Mg and 25 to 0.1 ppm of Ca.

2. A method of manufacturing clean steel comprising refining molten steel by adding metallic calcium or calcium-containing alloy of from less than 0.1 to more than 0.001% by weight of molten steel with the aid of an iron sheathed calcium clad wire in vacuo or a non-oxidizing atmosphere within a melting furnace or vessel made of or lined with a basic refractory material consisting essentially of 7–90 wt% of CaO and 90–7 wt% of MgO, wherein the total content of CaO and MgO is 70% to 99.9%, and wherein there is included a supplemental basic refractory material consisting of 30–0.1 wt% of at least one element selected from the group consisting of $Al_2O_3$, CaO, $ZrO_2.SiO_2$, $ZrO_2$, $SiO_2$, ZrC and C as supplemental components, and adding less than 5% of a solvent, and obtaining clean steel containing less than 20 ppm of oxygen, less than 20 ppm of sulfur, less than 150 ppm of nitrogen, 5 to 0.1 ppm of Mg and 25 to 0.1 ppm of Ca.

3. A method of manufacturing clean steel comprising refining molten steel by adding an iron sheathed calcium clad wire containing metallic calcium or metallic calcium-containing alloy of from less than 0.1% to more than 0.001% by weight of molten steel and with less than 5% of a solvent selected from the group consisting of halide, carbide and carbonate of alkali or alkali earth metal, in vacuo or a non-oxidizing atmosphere within the melting furnace or vessel made of a furnace wall or lined with a basic refractory material consisting essentially of 7–90 wt% of CaO and 0–7 wt% of MgO, wherein the total content of CaO and MgO is 70% to 99.9%, and wherein there is included another refractory material consisting of 30–0.1 wt% selected from the group consisting of $Al_2O_3$, CaO, $ZrO_2.SiO_2$, $ZrO_2$, $SiO_2$, ZrC and C as supplemental components and obtaining clean steel containing less than 20 ppm of oxygen, less than 20 ppm of sulfur, less than 150 ppm of nitrogen, 5 to 0.1 ppm of Mg and 25 to 0.1 ppm of Ca.

4. A method of manufacturing clean steel comprising refining molten steel by adding additives consisting of Al with at least one element selected from Ti, Nb, Ta, B and alkali earth metal from not more than 0.5% to more than 0.001% by weight of molten steel bath, and less than 5% of a solvent; in vacuo or a non-oxidizing atmosphere within a melting furnace or vessel made of or lined with a basic refractory material consisting essentially of 7–90 wt% of CaO and 90–7 wt% of MgO, the total contact of CaO and MgO being 70% to 99.9%, and wherein there is included another refractory material consisting of 30–0.1 wt% of at least one element selected from the group consisting of $Al_2O_3$, CrO, $ZrO_2.SiO_2$, $ZrO_2$, $SiO_2$, ZrC and C as supplemental components, and obtaining clean steel containing less than 30 ppm of oxygen, less than 30 ppm of sulfur, less than 150 ppm of nitrogen, 5 to 0.1 ppm of Mg and 25 to 0.1 ppm of Ca.

5. A method of manufacturing clean steel comprising refining molten steel by adding an additive of from not more than 0.5% to more than 0.001% by weight of molten steel to the molten steel bath; wherein said additive to Al, and less than 5% of a solvent; in vacuo or a non-oxidizing atmosphere within a melting furnace or vessel made of or lined with a basic refractory material consisting essentially of 7–90 wt% of CaO and 90–7wt% of MgO, wherein the total content of CaO and MgO is 70% to 99.9%, and wherein there is included another refractory material consisting of 30–0.1 wt% of at least one element selected from the group consisting of $Al_2O_3$, CrO, $ZrO_2.SiO_2$, $ZrO_2$, $SiO_2$, ZrC and C as supplemental components, and obtaining clean steel containing less than 30 ppm of oxygen, less than 30 ppm of sulfur, less than 150 ppm of nitrogen 5 to 0.1 ppm of Mg and 215 to 0.1 ppm of Ca.

* * * * *

UNITED STATES PATENT AND TRADEMARK OFFICE

CERTIFICATE OF CORRECTION

PATENT NO. : 4,944,798

DATED : July 31, 1990

INVENTOR(S) : Tohei OTOTANI

It is certified that error appears in the above-identified patent and that said Letters Patent is hereby corrected as shown below:

Col. 5, lines 29-31, delete "additives of from not more than 0.5% to more than 0.001% by weight.

Col. 6, line 15, delete "0-7" and insert --90-7--.

Signed and Sealed this

Fifth Day of May, 1992

*Attest:*

DOUGLAS B. COMER

*Attesting Officer*

*Acting Commissioner of Patents and Trademarks*